US011297434B1

(12) United States Patent
Kim et al.

(10) Patent No.: US 11,297,434 B1
(45) Date of Patent: Apr. 5, 2022

(54) APPARATUS AND METHOD FOR SOUND PRODUCTION USING TERMINAL

(71) Applicant: Fdn. for Res.&Bus., Seoul Nat. Univ. of Sci.&Tech., Seoul (KR)

(72) Inventors: Dong Ho Kim, Seoul (KR); Bong-Seok Seo, Gyeonggi-do (KR); Subin Hwang, Seoul (KR)

(73) Assignee: Fdn. For Res. & Bus., Seoul Nat. Univ. Of Sci. & Tech., Seoul (KR)

( * ) Notice: Subject to any disclaimer, the term of this patent is extended or adjusted under 35 U.S.C. 154(b) by 0 days.

(21) Appl. No.: 17/117,287

(22) Filed: Dec. 10, 2020

(30) Foreign Application Priority Data

Dec. 8, 2020 (KR) ..... 10-2020-0170400

(51) Int. Cl.
*H04R 5/033* (2006.01)
*H04R 5/02* (2006.01)
*H04R 5/04* (2006.01)

(52) U.S. Cl.
CPC ..... *H04R 5/033* (2013.01); *H04R 5/02* (2013.01); *H04R 5/04* (2013.01)

(58) Field of Classification Search
CPC ..... H04R 5/033; H04R 5/02; H04R 5/04
See application file for complete search history.

(56) References Cited

U.S. PATENT DOCUMENTS 9,066,170 B2 * 6/2015 Forutanpour ..... H04R 3/005
11,095,978 B2 * 8/2021 Gigandet ..... H04R 25/405

FOREIGN PATENT DOCUMENTS

KR 10-1415026 5/2009

* cited by examiner

*Primary Examiner* — Andrew L Sniezek
(74) *Attorney, Agent, or Firm* — HoustonHogle LLP

(57) ABSTRACT

An apparatus and method of producing sound using a terminal is proposed. According to an embodiment of the present invention, it is possible to provide realistic sound when playing contents and easily produce contents with improved immersion by making uniform a sound received through the microphone of the lightweight terminal through distortion compensation and recording the uniform sound in a stereophonic manner.

4 Claims, 3 Drawing Sheets

APPARATUS AND METHOD FOR SOUND PRODUCTION USING TERMINAL

RELATED APPLICATIONS

This application claims priority to Korean Application No. 10-2020-0170400, filed on Dec. 8, 2020, which is incorporated herein by reference in its entirety.

BACKGROUND OF THE INVENTION

Field of the Invention

The present invention relates to an apparatus and method for sound production using a terminal and, more particularly, to a technique capable of making uniform sounds received through a predetermined number of microphones of the terminal through distortion compensation, recording the uniform sound in a stereophonic manner, and producing contents with the obtained stereophonic sound.

Description of the Related Art

Recently, various algorithms in which a uniform image is maintained by correcting screen shaking through a video recording method using an action cam, a gimbal, a smartphone, and the like have been commercialized. In the case of audio, a uniform sound is reproduced by directly receiving the sounds without additional correction or by performing post synchronization.

In the case of an image captured using a smartphone or an action cam, image shaking is corrected in a software manner for a specific area in an image with a wide angle of view. Meanwhile, the sounds received by the microphone become very non-uniform by the microphone shaking, and thus non-uniform sounds are recorded.

Recently, a uniform sound is separately produced by using an external sound receiver that corrects the non-uniform sound, performing post synchronization, and so on. Therefore, contents production processes are complicated, and there is a limit that the production period and production costs increase.

Accordingly, the applicant of the present invention has proposed a method of providing realistic sounds when playing contents and making contents production easy by making uniform sounds received through the microphone of the lightweight terminal through distortion compensation and recording the uniform sounds in a stereophonic manner.

DOCUMENTS OF RELATED ART (Patent Document 1) Korean Patent No. 1415026 (Method and apparatus for multi-channel sound acquisition using microphone array)

SUMMARY OF THE INVENTION

Accordingly, the present invention has been made keeping in mind the above problems occurring in the prior art, and an objective of the present invention is to provide an apparatus and method for sound production using a terminal, the apparatus and method configured to be capable of providing realistic sounds when playing contents by making uniform sounds received through the microphone of the lightweight terminal through distortion compensation and recording the uniform sounds in a stereophonic manner.

Accordingly, an objective of the present invention is to provide an apparatus and method for sound production using a terminal, the apparatus and method configured to be capable of easily producing contents with improved immersion.

The objective of the present invention is not limited to the above-mentioned objectives, and it will be appreciated by those skilled in the art that other objectives and advantages of the present invention that are not mentioned may be understood by the following description and will become clearly by examples of the present invention. In addition, it will be easily understood that the objectives and advantages of the present invention can be realized by means shown in the claims and combinations thereof.

An apparatus for sound production using a terminal according to an embodiment of the present invention includes a sound receiver receiving sounds from a predetermined number of microphones of a lightweight terminal; a sound direction extraction unit extracting directions of the received sounds using a mobile transfer function with respect to a terminal direction obtained by a plurality of sensors of the terminal; and a sound production unit obtaining a uniform sound by compensating distortions related to the extracted directions of the received sounds.

Preferably, the sound production unit may be configured to produce multi-channel stereophonic sounds by adding a distorted sound to the uniform sound and transmit the stereophonic sounds to a contents production device.

Preferably, the sound direction extraction unit may be configured to generate direction signals of the received sounds using direction information of the terminal, which is detected using an acceleration sensor and a magnetic field sensor; generate direction correction signals for correcting the direction signals based on the direction information of the terminal, which is detected using a gyro sensor; and correct the direction signals of the received sounds with the direction correction signals, thereby extracting the directions of the received sounds.

Preferably, the sound direction extraction unit may include a filtering module filtering detection signals from at least one of an acceleration sensor and a magnetic field sensor and a gyro sensor using a low pass filter of a predetermined frequency band; a direction signal generation module generating direction signals of the received sounds by performing preprocessing on at least one of the filtered detection signals from the acceleration sensor and the magnetic field sensor; a direction correction signal generation module generating the direction correction signals for the received sounds by performing preprocessing on the filtered detection signals from the gyro sensor; and a sound direction extraction module correcting the direction signals with the direction correction signals, thereby extracting the directions of the received sounds.

A method for sound production using a terminal according to another embodiment of the present invention includes receiving sounds from a predetermined number of microphones of a lightweight terminal; extracting directions of the received sounds on the basis of detection signals from a plurality of sensors of the lightweight terminal; obtaining a uniform sound by compensating distortions related to the extracted directions of the received sounds; and adding a distorted sound to the uniform sound to produce a stereophonic sound and transmit the stereophonic sound to a contents production device.

According to the present invention, it is possible to provide realistic sounds when playing contents by making uniform a sound received through the microphone of the lightweight terminal through distortion compensation and recording the uniform sound in a stereophonic manner.

In addition, there is an effect that it is possible to easily produce contents with improved immersion.

BRIEF DESCRIPTION OF THE DRAWINGS

The accompanying drawings with respect to the specification illustrate preferred embodiments of the present invention and serve to further convey the technical idea of the present invention together with the description of the present invention given below, and accordingly the present invention should not be construed as limited only to descriptions in the drawings, in which.

DETAILED DESCRIPTION OF THE INVENTION

Figure 1:
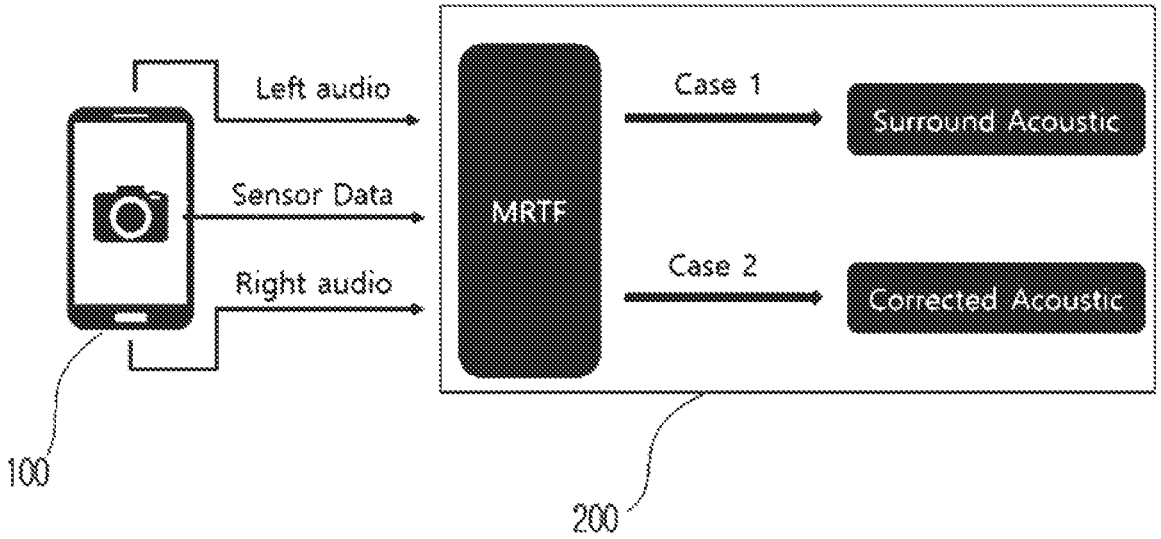
FIG. 1 is a configuration diagram showing a contents production system to which an embodiment is applied.

Hereinafter, embodiments of the present invention will be described in more detail with reference to the drawings.

Advantages and features of the present invention, and methods of achieving them will become apparent with reference to the embodiments described later together with the accompanying drawings. However, the present invention is not limited to the embodiments disclosed below, but may be implemented in various different forms. The embodiments are provided to complete the disclosure of the present invention, and to completely inform the scope of the invention to those of ordinary skill in the art to which the present invention belongs. The invention is only defined by the scope of the claims.

The terms used herein will be briefly described, and the present invention will be described in detail.

Terms used in the present invention have selected general terms that are currently widely used as possible while considering functions in the present invention, but this may vary according to the intention or precedent of a technician working in the field, the emergence of new technologies, and the like. In addition, in certain cases, there are terms arbitrarily selected by the applicant, and in this case, the meaning of the terms will be described in detail in the description of the corresponding invention. Therefore, the terms used in the present invention should be defined based on the meaning of the term and the overall contents of the present invention, not a simple name of the term.

When a part is said to "include" one component throughout the specification, it means that other components may be further included rather than excluding other components unless otherwise specified. In addition, the term "unit" used herein refers to a hardware component such as software, FPGA, or ASIC, and the "unit" serves to take certain roles. However, the "unit" is not meant to be limited to software or hardware. The "unit" may be configured to be in an addressable storage medium or may be configured to reproduce one or more processors.

Accordingly, as an example, the "unit" includes components such as software components, object-oriented software components, class components, and task components, processes, functions, properties, procedures, subroutines, segments of program code, drivers, firmware, microcode, circuits, data, databases, data structures, tables, arrays, and variables. The functions provided within the components and the "units" may be combined into a smaller number of components and "units" or may be further separated into additional components and "units".

Prior to the description of the present specification, some terms used herein will be clarified. In the present specification, the received sound refers to an acoustic signal received through a microphone, so that the sound or the received sound will be described in an interchangeable manner.

Hereinafter, embodiments of the present invention will be described in detail with reference to the accompanying drawings so that those of ordinary skill in the art may easily implement the present invention. In the drawings, parts not related to the description are omitted in order to clearly describe the present invention.

Figure 2:
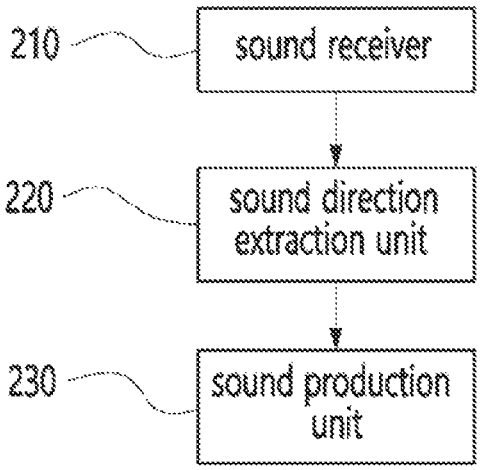
FIG. 2 is a block diagram showing an apparatus for sound production using a terminal according to an embodiment.

FIG. 1 is a configuration diagram showing a contents production system to which an embodiment is applied; FIG. 2 is a block diagram showing an apparatus for sound production using a terminal according to an embodiment; and FIG. 3 is a detailed configuration diagram of a sound direction extraction unit of the apparatus according to an embodiment.

Figure 3:
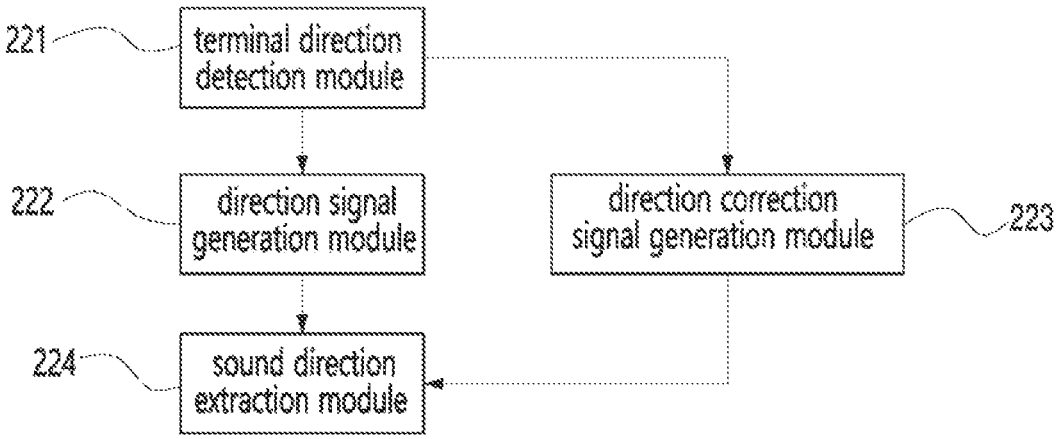
FIG. 3 is a detailed configuration diagram of a sound direction extraction unit of the apparatus according to an embodiment.

Referring to FIGS. 1 to 3, an apparatus for sound production using a terminal according to an embodiment is provided to make uniform sounds received through the microphone of the lightweight terminal through distortion compensation and then add distorted sounds to the uniform sounds in order to produce the stereophonic sound. The apparatus for sound production may include a terminal 100 and a sound production device 200.

The terminal 100 is a lightweight device and may be provided with a predetermined number of microphones to receive the sounds simultaneously. That is, in the case of more than half the wavelength ($\lambda/2$) of the sound wave according to characteristics of the sounds supplied from the outside, the sound may be received simultaneously through two microphones.

For example, in the case that the terminal is a smartphone equipped with a microphone for calling and a microphone for recording, when the screen size is 6 inches and the screen height is 160 mm, the distance between the microphones is 150 mm so that the sounds above 1 Khz are received simultaneously by two microphones.

In addition, as shown in FIG. 2, the sound production device 200 is configured to extract the directions of the sounds received through the terminal 100 according to the shaking of the terminal, obtain a uniform sound by compensating the distortion generated on the basis of the extracted direction, add a distorted sound to the obtained uniform sound to produce the stereophonic sound, and transmit the produced stereophonic sound to the contents production device. The sound production device 200 may include a sound receiver 210, a sound direction extraction unit 220, and a sound production unit 230.

The sound receiver 210 receives the sounds received from a predetermined number of microphones of the lightweight terminal 100. Here, the received sounds are transmitted to the sound direction extraction unit 220. In addition, the sound receiver 210 transmits the detection signals received from a plurality of sensors in the lightweight terminal 100 to the sound direction extraction unit 220.

In addition, the sound direction extraction unit 220 is provided to extract the directions of the sounds from the shaking information of the terminal, on the basis of detection signals of each sensor, which is transmitted from the sound receiver 210, and correct the distortions of the received sounds on the basis of the extracted directions of the sounds, thereby obtaining a uniform sound. Accordingly, the sound direction extraction unit 220 may include a terminal direction detection module 221, a direction signal generation module 222, a direction correction signal generation module 223, and a sound direction extraction module 224, as shown in FIG. 3.

The terminal direction detection module 221 extracts the direction in which the terminal is shaken on the basis of the detection signals of each sensor of the terminal 100, which is transmitted from the sound receiver 210.

For example, in the terminal direction detection module 221, each detection signal of an acceleration sensor, a magnetic field sensor, and a gyro sensor is filtered using a low pass filter of a predetermined frequency band, and the filtered detection signals from the acceleration sensor and the magnetic field sensor are transmitted to the direction signal generation module 222.

In addition, the direction signal generation module 222 converts the detection signals of the acceleration sensor and magnetic field sensor, which pass using the low pass filter, into a matrix value, and then removes noises included in the converted detection signals from the acceleration sensor and magnetic field sensor or interpolates the converted detection signals from the acceleration sensor and magnetic flux sensor, thereby extracting the direction signals of the received sounds. Here, the directions of received sounds are the same direction as the direction in which the terminal is shaken. The interpolation for the detection signals of the acceleration sensor and the magnetic flux sensor is performed in a second-order approximation manner.

The direction signal generation module 222 filters the direction signal indicating the shaking for the sounds using a low pass filter of a predetermined frequency band, and then transmits the same to the sound direction extraction module 224.

Meanwhile, the terminal direction detection module 221 transmits the detection signal of the gyro sensor to the direction correction signal generation module 223.

Accordingly, the direction correction signal generation module 223 converts the received detection signals of the gyro sensor into a matrix value, removes noises included in the converted detection signals from the gyro sensor or interpolates the converted output signals from the gyro sensor in order to generate direction correction signals of the received sounds, and transmits the generated direction correction signals to the sound direction extraction module 224. Herein, the interpolation of the converted output signals from the gyro sensor is performed in a second-order approximation manner.

The sound direction extraction module 224 corrects the direction signals generated by the direction signal generation module 222 according to the direction correction signal generated by the direction correction signal generation module 223, and then transmits the corrected sound direction signals to the sound production unit 230.

The sound production unit 230 corrects the distortions of the received sounds according to the sound direction signals to obtain the uniform sound, and transmits the obtained uniform sound to a contents production device (not shown).

As another example, the sound production unit 230 converts the uniform sound into multi-channel sounds by adding distorted sound to the uniform sound, thereby producing a stereophonic sound, and then transmits the produced stereophonic sound to the contents production device. For example, 2 channels of received sound are transformed into multiple channels, 5.1 channels or 7.1 channels of stereophonic sound.

As still another example, the sound production unit 230 may produce correction sounds that look like it comes from one direction by adding a distorted sound to the uniform sound. Here, the rear sounds are generated in such a manner as to be the same as the front sounds of the speaker that reproduces the sounds of contents, as the distorted sound results from inverse distortion on the basis of the front sound and the resulting distorted sound is added to the uniform sound.

Therefore, according to an embodiment, it is possible to provide sounds full of realism when playing contents, and produce contents with improved immersion easily, by making uniform sounds received through the microphone of the lightweight terminal through distortion compensation, and then recoding the uniform sound in a stereophonic manner.

Figure 4:
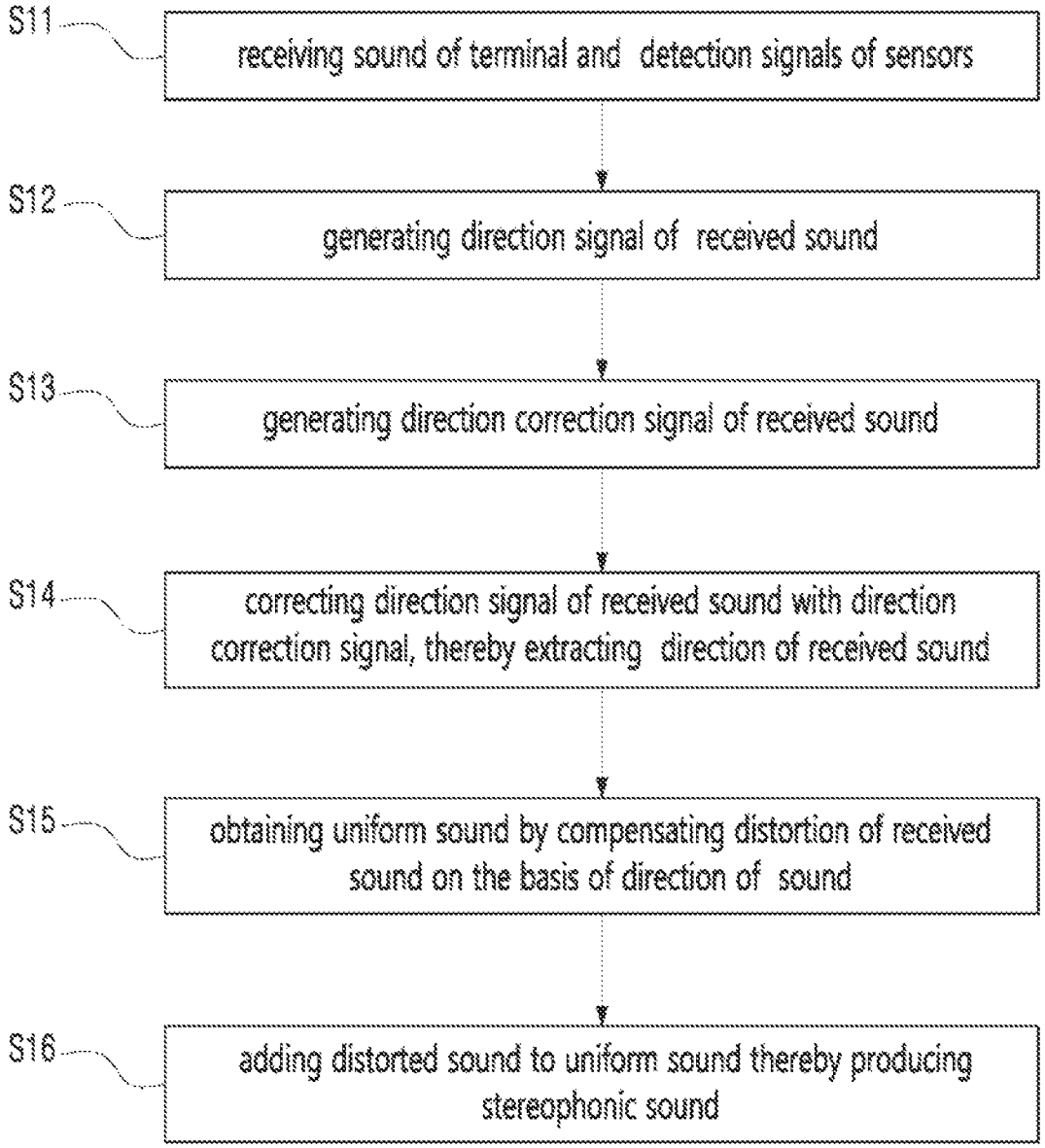
FIG. 4 is an overall flowchart showing a method for sound production using a terminal according to another embodiment.

FIG. 4 is an overall flowchart showing operation processes of the sound production apparatus shown in FIG. 2. Referring to FIG. 4, a method for sound production using a terminal according to another embodiment of the present invention will be described.

First, in step S11, the sound receiver 210 according to an embodiment receives the sounds from a predetermined microphone of the terminal 100, and receives detection signals from each sensor of the terminal 100. The detection signals of each sensor are transmitted to the sound direction extraction unit 220.

In steps S12 to S14, the sound direction extraction unit 220 according to an embodiment generates direction signals and sound direction correction signals of the sounds with respect to the detection signals of each sensor of the terminal 100, and corrects the generated direction signals with the direction correction signal, thereby extracting the directions of the sounds. In addition, the extracted sound directions are transmitted to the sound production unit 230.

In steps S15 and S16, the sound production unit 230 according to an embodiment obtains the uniform sound by compensating the distortion of the received sounds on the basis of the sound direction, adds a distorted sound to the obtained uniform sound thereby producing a multi-channel stereophonic sound, and transmits the produced stereophonic sound to the content production device.

The content production device produces contents on the basis of the received stereophonic sound. It is possible to provide realistic sounds when playing contents, and thus produce contents with improved immersion easily, by making uniform sounds received through the microphone of the lightweight terminal through distortion compensation, and recording the uniform sound in a stereophonic manner.

The present invention has been described with reference to the embodiment shown in the drawings, but this is only exemplary, and those of ordinary skill in the art will appreciate that various modifications and other equivalent embodiments are possible therefrom. Therefore, the technical protection scope of the present invention should be determined by the following claims.

The present invention can bring about a great progress in terms of operation accuracy and reliability and further performance efficiency for the apparatus and method for sound production using a terminal, which is configured to be capable of providing realistic sounds when playing contents and easily producing contents with improved immersion by making uniform sounds received through the microphone of the lightweight terminal through distortion compensation and recording the uniform sound in a stereophonic manner. In addition, the present invention has industrial applicability because it has sufficient potential for commercialization or business of AR and VR systems, as well as it is capable of being practically implemented.

What is claimed is:

1. An apparatus for sound production using a terminal, the apparatus comprising:

a sound receiver receiving sounds from a predetermined number of microphones of a lightweight terminal;

a sound direction extraction unit extracting directions of the received sounds with respect to a terminal direction obtained by a plurality of sensors of the terminal; and a sound production unit obtaining a uniform sound by compensating distortions related to the extracted directions of the received sounds, wherein the sound production unit is configured to produce multi-channel stereophonic sounds by adding a distorted sound to the uniform sound and transmit the stereophonic sounds to a contents production device.

2. The apparatus of claim 1, wherein the sound direction extraction unit is configured to:

generate direction signals of the received sounds using direction information of the terminal, which is detected using an acceleration sensor and a magnetic field sensor;

generate direction correction signals for correcting the direction signals based on the direction information of the terminal, which is detected using a gyro sensor; and correct the direction signals of the received sounds with the direction correction signals, thereby extracting the directions of the received sounds.

3. The apparatus of claim 1, wherein the sound direction extraction unit comprises:

a filtering module filtering detection signals from at least one of an acceleration sensor and a magnetic field sensor and a gyro sensor using a low pass filter of a predetermined frequency band;

a direction signal generation module generating direction signals of the received sounds by performing preprocessing on at least one of the filtered detection signals from the acceleration sensor and the magnetic field sensor;

a direction correction signal generation module generating direction correction signals for the received sounds by performing preprocessing on the filtered detection signals from the gyro sensor; and a sound direction extraction module correcting the direction signals with the direction correction signals, thereby extracting the directions of the received sounds.

4. A method for sound production using a terminal, the method comprising:

receiving sounds from a predetermined number of microphones of a lightweight terminal;

extracting directions of the received sounds on the basis of detection signals from a plurality of sensors of the lightweight terminal;

obtaining a uniform sound by compensating distortions related to the extracted directions of the received sounds; and adding a distorted sound to the uniform sound to produce a stereophonic sound and transmit the stereophonic sound to a contents production device.

* * * * *